US009876297B2

(12) United States Patent
Takane

(10) Patent No.: US 9,876,297 B2
(45) Date of Patent: Jan. 23, 2018

(54) CONNECTOR

(71) Applicant: IRISO ELECTRONICS CO., LTD., Yokohama, Kanagawa (JP)

(72) Inventor: Toru Takane, Kanagawa (JP)

(73) Assignee: IRISO ELECTRONICS CO., LTD., Kanagawa (JP)

( * ) Notice: Subject to any disclaimer, the term of this patent is extended or adjusted under 35 U.S.C. 154(b) by 0 days.

(21) Appl. No.: 15/364,376

(22) Filed: Nov. 30, 2016

(65) Prior Publication Data

US 2017/0170587 A1 Jun. 15, 2017

(30) Foreign Application Priority Data

Dec. 9, 2015 (JP) ..... 2015-239938

(51) Int. Cl.
*H01R 12/00* (2006.01)
*H01R 12/77* (2011.01)
(Continued)

(52) U.S. Cl.
CPC ..... *H01R 12/774* (2013.01); *H01R 12/716* (2013.01); *H01R 12/777* (2013.01);
(Continued)

(58) Field of Classification Search
CPC .. H01R 12/774; H01R 12/0277; H01R 12/79; H01R 12/716; H01R 12/88; H01R 12/57; H01R 12/777; H01R 2201/06; H01R 13/025; H01R 13/62988; H01R 13/187; H01R 2107/00
(Continued)

(56) References Cited

U.S. PATENT DOCUMENTS 9,585,244 B2 * 2/2017 Yagisawa ..... H05K 1/0277
2004/0023551 A1 * 2/2004 Suzuki ..... H01R 12/592 439/495
(Continued)

FOREIGN PATENT DOCUMENTS

CN 102842798 A 12/2012
CN 102842811 A 12/2012
(Continued)

OTHER PUBLICATIONS

European Search Report for European Patent App. No. 16200661.3 dated Mar. 28, 2017.

*Primary Examiner* — Jean F Duverne
(74) *Attorney, Agent, or Firm* — Cermak Nakajima & McGowan LLP; Tomoko Nakajima

(57) ABSTRACT

A connector includes a housing that has a fitting chamber with an insertion opening for a flat conductor in the upper surface thereof and whose lower side is placed on a circuit board, a locking spring that locks the flat conductor, and an unlocking member. The locking spring is provided with a housing fixing portion, an elastic arm that is rotationally displaced about the housing fixing portion away from the flat conductor, an engaging piece that engages with a locking portion of a through-shape provided in the flat conductor, and a sliding contact portion that comes into oblique sliding contact with the unlocking member displaced by a pressing operation, rotates the elastic arm, and extracts the engaging piece from the locking portion.

13 Claims, 17 Drawing Sheets

(51) Int. Cl.

| | |
|---|---|
| ***H01R 12/71*** | (2011.01) |
| ***H01R 13/02*** | (2006.01) |
| ***H01R 13/187*** | (2006.01) |
| ***H01R 13/629*** | (2006.01) |
| ***H01R 12/87*** | (2011.01) |
| ***H01R 13/426*** | (2006.01) |
| ***H01R 13/635*** | (2006.01) |
| *H01R 107/00* | (2006.01) |
| *H01R 12/79* | (2011.01) |

(52) U.S. Cl.
CPC ..... *H01R 12/87* (2013.01); *H01R 13/025* (2013.01); *H01R 13/187* (2013.01); *H01R 13/426* (2013.01); *H01R 13/62988* (2013.01); *H01R 13/635* (2013.01); *H01R 12/778* (2013.01); *H01R 12/79* (2013.01); *H01R 2107/00* (2013.01); *H01R 2201/06* (2013.01)

(58) Field of Classification Search
USPC ..... 439/83
See application file for complete search history.

(56) References Cited

U.S. PATENT DOCUMENTS

2004/0033717 A1* 2/2004 Peng ..... H01R 12/57 439/495
2007/0072446 A1* 3/2007 Hashimoto ..... H01R 12/88 439/66
2007/0076400 A1* 4/2007 Shimada ..... H01R 12/88 361/809
2009/0017645 A1* 1/2009 Suzuki ..... H01R 12/88 439/62
2009/0068860 A1* 3/2009 Suzuki ..... H01R 12/88 439/67
2009/0317987 A1* 12/2009 Tanaka ..... H01R 12/778 439/67
2010/0055940 A1* 3/2010 Wang ..... H01R 12/79 439/77
2012/0064749 A1 3/2012 Hashimoto
2012/0238118 A1* 9/2012 Yoshida ..... H01R 12/57 439/259
2012/0289092 A1* 11/2012 Shimada ..... H01R 13/641 439/629
2013/0065417 A1* 3/2013 Kurachi ..... H01R 12/79 439/325
2014/0141629 A1* 5/2014 Yagisawa ..... H05K 1/0277 439/77

FOREIGN PATENT DOCUMENTS

| | | | |
|---|---|---|---|
| EP | 2442408 | A1 | 4/2012 |
| EP | 2922151 | A1 | 9/2015 |
| JP | 2012-059535 | A | 3/2012 |

* cited by examiner

CONNECTOR

BACKGROUND OF THE INVENTION

1. Field of the Invention

The present invention relates to a connector that electrically connects a flat conductor and a circuit board.

2. Description of the Related Art

Heretofore, connectors that are mounted on a circuit board and electrically connect Flexible printed circuits (FPC), an Flexible flat cable (FFC), or the like (referred to as "flat conductor" in this specification and the claims) and the circuit board, have been used as connectors used in electronic devices. These connectors can connect a unit in a device such as a computer or a liquid crystal display and a circuit board in various forms, and are therefore mounted in many electronic devices.

Examples of such connectors include those including locking members having engaging portions that engage with recessed portions provided in side edges of a flat conductor. By engaging the engaging portions with the recessed portions of the flat conductor, with the flat conductor and terminals electrically connected, the flat conductor is fixed to the connector. When pulling out the flat conductor from this connector, by pressing operating portions of the locking members in advance, the engaging portions are disengaged from the recessed portions, and by pulling the flat conductor from the connector in that state, the flat conductor can be easily pulled out from the connector (for example, Japanese Unexamined Patent Application Publication No. 2012-59535).

The engaging portions of the locking members described above are connected to the operating portions, and are displaced in the same direction as the pressing direction of the operating portions. Therefore, in order to disengage the engaging portions from the recessed portions of the flat conductor, it is necessary to press the operating portions to largely displace the engaging portions away from the flat conductor. Therefore, when inserting the flat conductor into the connector perpendicularly to the plate surface of the circuit board, a large space for displacing the operating portions is necessary around the connector.

The present invention has been made on the background of the above-described conventional art, and it is an object of the present invention to provide a connector such that even when there is no large space around the connector, the operation of disengaging locking members from a flat conductor can be easily performed.

SUMMARY OF THE INVENTION

To attain the above object, the present invention is configured as follows.

In an aspect of the present invention, a connector includes a housing that has a fitting chamber with an insertion opening for a flat conductor in the upper surface thereof and whose lower side is placed on a circuit board, at least one locking spring that locks the flat conductor in the fitting chamber, and an unlocking member that is displaced by a pressing operation toward the circuit board. The at least one locking spring has a fixing portion that is fixed to the housing, an elastic arm that is rotationally displaced about the fixing portion away from the flat conductor, an engaging piece that engages with a locking portion of a through-shape provided in the flat conductor, and a sliding contact portion that comes into oblique sliding contact with the unlocking member displaced by the pressing operation, rotates the elastic arm about the fixing portion away from the flat conductor, and extracts the engaging piece from the locking portion.

According to the present invention, by pressing the unlocking member displaced by a pressing operation toward the circuit board, the engaging piece can be extracted from the locking portion of the flat conductor, and the engagement can be released. Therefore, for example, even when components are densely mounted around the connector, and there is no space for pressing and displacing the unlocking member away from the flat conductor, the flat conductor can be easily disengaged. In addition, because the pressing operation toward the circuit board can be sensuously performed for a worker, the operation can be easily performed.

The housing may have at least one groove portion that is open to the outside of the housing and houses the at least one locking spring displaceably to the outside of the housing.

Since the housing has at least one groove portion that is open to the outside of the housing and houses the at least one locking spring displaceably to the outside of the housing, the displaceable locking spring can be displaced from the groove portion of the housing to the outside. Therefore, it is not necessary to secure a space for displacing the locking spring in the housing, and therefore the housing can be reduced in size.

The at least one locking spring may have a flat plate shape.

Since the at least one locking spring has a flat plate shape, the size can be reduced in the width direction of the housing. Such a flat plate-shaped locking spring can be configured as a stamped terminal made by stamping a flat metal plate.

The at least one locking spring may include a plurality of locking springs, and the plurality of locking springs may be disposed at both ends in the width direction of the insertion opening.

Since the housing includes a plurality of locking springs, the flat conductor can be reliably locked at a plurality of positions.

The sliding contact portion may be an oblique edge formed in a protruding piece protruding obliquely from the distal end of the elastic arm.

Since the sliding contact portion is an oblique edge formed in a protruding piece protruding obliquely from the distal end of the elastic arm, pressing operating force applied to the unlocking member can be smoothly converted into rotational displacing force that rotates the elastic arm by bringing the unlocking member into oblique sliding contact with the oblique edge.

The engaging piece may protrude from the lower end of the oblique edge toward the fitting chamber.

Since the engaging piece protrudes from the lower end of the oblique edge toward the fitting chamber, the engaging piece reliably interlocks with the rotation of the elastic arm, and therefore the engaging piece can be reliably extracted from the locking portion.

The unlocking member may have at least one pressing operating surface on the upper surface side of the housing in which the insertion opening is open.

Since the unlocking member has at least one pressing operating surface on the upper surface side of the housing, the at least one pressing operation surface can be pressed down from above the housing, and therefore pressing operation can be easily performed.

The at least one pressing operating surface may be located above the upper surface of the housing.

Since the at least one pressing operating surface is located above the upper surface of the housing, fingers that perform pressing operation can easily touch the at least one pressing operation surface, and pressing operation can be reliably performed.

The at least one pressing operating surface may include a plurality of pressing operating surfaces, and the plurality of pressing operating surfaces may be located at both ends in the longitudinal direction of the upper surface of the housing.

Since the at least one pressing operating surface includes a plurality of pressing operating surfaces, and the plurality of pressing operating surfaces are located at both ends in the longitudinal direction of the upper surface of the housing, pressing operation can be reliably performed by operating the plurality of pressing operating surfaces.

The at least one pressing operating surface may include a plurality of pressing operating surfaces, and the plurality of pressing operating surfaces may be located so as to protrude to the side of both ends in the longitudinal direction of the upper surface of the housing.

Since the at least one pressing operating surface includes a plurality of pressing operating surfaces, and the plurality of pressing operating surfaces are located so as to protrude to the side of both ends in the longitudinal direction of the upper surface of the housing, fingers that perform pressing operation can easily touch the plurality of pressing operation surfaces such that they interfere with the upper surface of the housing as little as possible, and the pressing operation can be reliably performed.

The at least one pressing operating surface may be a flat surface.

During automatic mounting, the flat pressing operation surface can be used as a sucked surface.

The unlocking member may have a first pressing operation surface located at one longitudinal end of the upper surface of the housing, a second pressing operation surface located at the other longitudinal end of the upper surface of the housing, and a connecting portion bridged between the first and second pressing operation surfaces along the longitudinal direction of the upper surface of the housing.

Since the unlocking member has an integral shape such that the first and second pressing operation surfaces are connected by the connecting portion, the lock of the flat conductor by the locking spring can be released by pressing one unlocking member, and the releasing operation can be easily performed.

The unlocking member may have an insertion portion through which the upper end of the elastic arm is passed, and, when the unlocking member is displaced by the pressing operation to a position where the engaging piece is extracted from the locking portion, the upper end of the elastic arm may protrude from the insertion portion.

In the present invention, when the upper end of the elastic arm protrudes from the insertion portion, it can be confirmed that the engaging piece is extracted from the locking portion. Therefore, by viewing it, the flat conductor can be appropriately extracted.

The at least one locking spring comprises a pair of locking springs, and the pair of locking springs may be disposed at both ends of a row of terminals electrically connected to the flat conductor.

By doing so, even when the number of terminals disposed between the locking springs is changed, the change can be easily coped with without changing the shape of the locking springs.

According to the present invention, a connector such that the engagement of a locking member with a flat conductor can be easily released, can be provided. Therefore, even when the connector is mounted at a position where components are densely mounted, the flat conductor can be easily disengaged.

DESCRIPTION OF THE PREFERRED EMBODIMENTS

Figure 1:
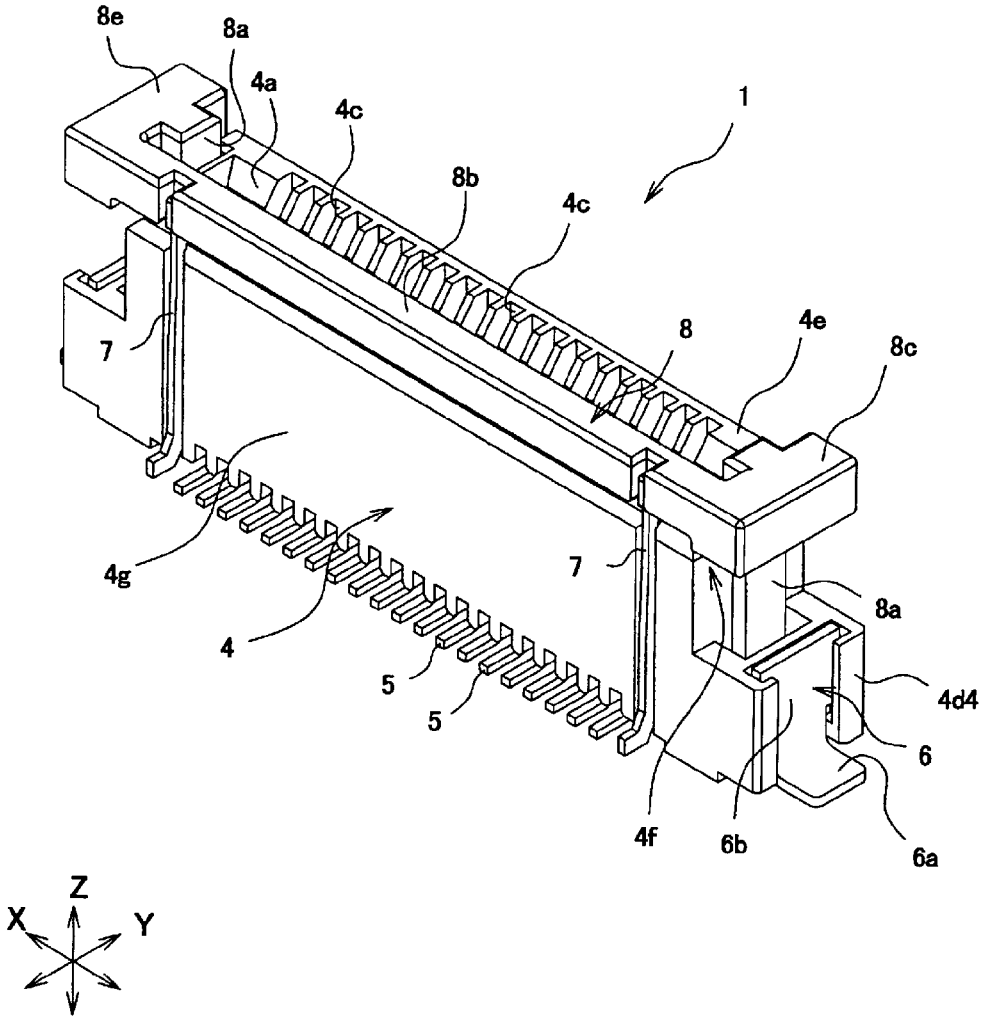
FIG. 1 is a perspective view showing the front, right side, and top of a connector according to an embodiment.

A preferred embodiment of a connector of the present invention will be described below with reference to the drawings. A connector 1 shown in the following embodiment is mounted on a circuit board 2, and electrically connects a flat conductor 3 such as an FPC or an FFC to a board circuit.

In this specification, the arrangement direction of terminals 5 (width direction) in the connector 1 is referred to as X direction, the front-back direction (short side direction) is referred to as Y direction, and the height direction (vertical direction) of the connector 1 is referred to as Z direction. In the front-back direction of the connector 1, the side on which a front wall 4*g* is provided is referred to as "front side," and the opposite side is referred to as "back side." In the height direction Z, the side of the circuit board 2 is referred to as "lower side," and the connector 1 side is referred to as "upper side." However, these do not limit the manner in which the connector 1 is mounted on the circuit board 2 and the manner in which the connector 1 is used. Because the left side view is symmetrical to the right side view, the depiction thereof is omitted.

Embodiment (FIG. 1 to FIG. 19)

The connector 1 in this embodiment is vertically mounted on a circuit board 2, a flat conductor 3 is inserted into the connector 1, and the connector 1 electrically connects the circuit board 2 and the flat conductor 3. The flat conductor 3 is inserted through an insertion opening 4*a* provided in the upper surface of the connector 1 into a fitting chamber 4*b*, along the height direction Z downward from above.

The configuration of the connector 1 of this embodiment will be described in detail below. As shown in FIGS. 1 to 7, the connector 1 includes a housing 4, terminals 5, reinforcing members 6, locking springs 7, and an unlocking member 8.

Housing

Figure 8:
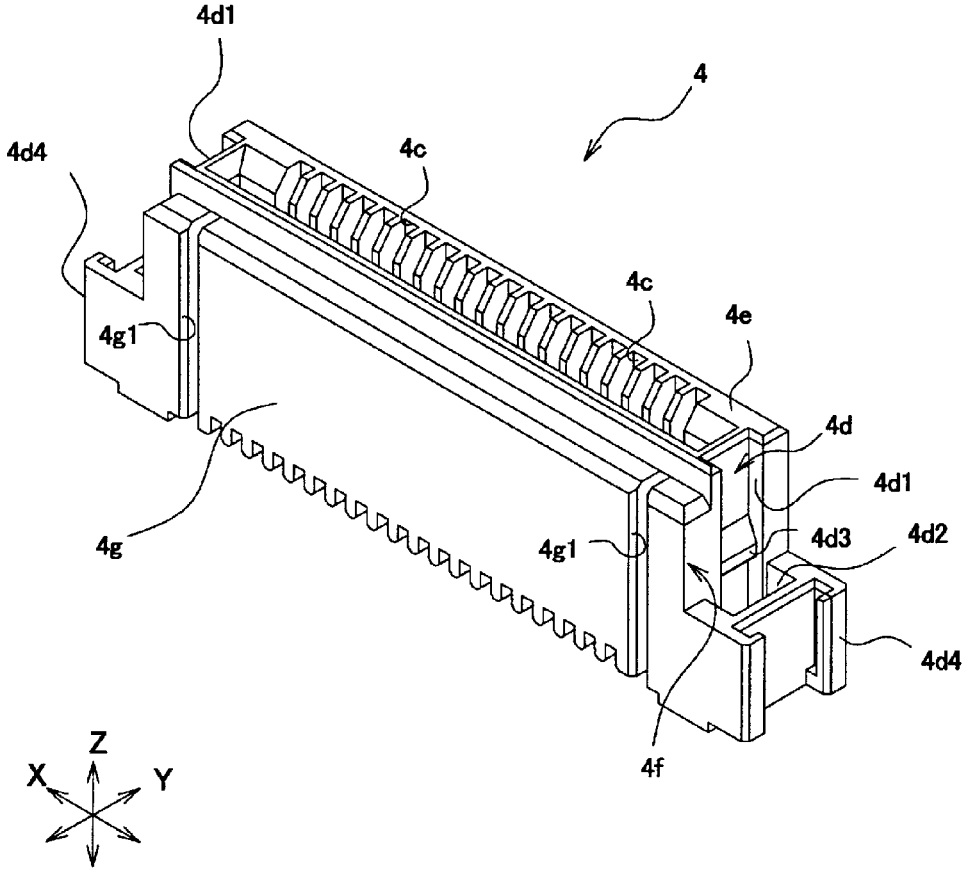
FIG. 8 is a perspective view showing the front, right side, and top of a housing provided in the connector of FIG. 1.
Figure 9:
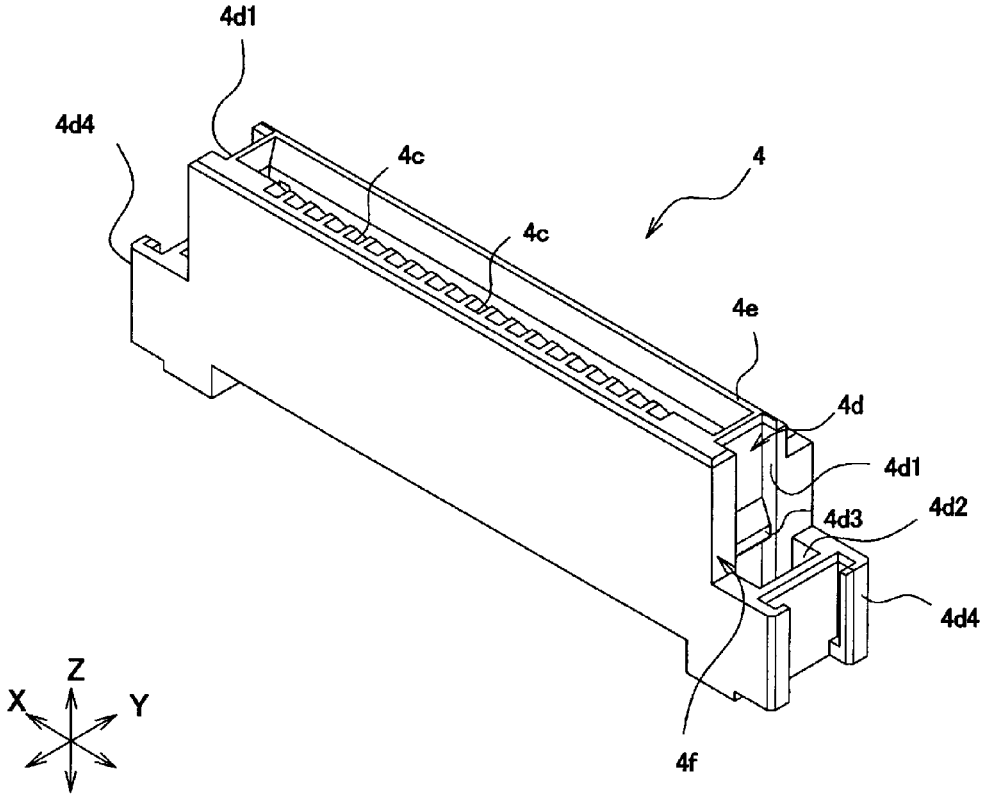
FIG. 9 is a perspective view showing the back, left side, and top of the housing of FIG. 8.

The housing 4 is made of an insulating resin, and is formed in a rectangular parallelepiped shape as shown in FIGS. 8 and 9. The housing 4 has a front wall 4*g*, side wall portions 4*f*, an insertion opening 4*a* for the flat conductor 3, a fitting chamber 4*b*, and terminal housing portions 4*c*.

The front wall 4*g* has an X-Z plane. The front wall 4*g* is provided with housing grooves 4*g*1 that are elongated grooves along the height direction Z and that serve as "groove portions." In this embodiment, the housing grooves 4*g*1 are disposed at both ends in the width direction X. Proximal ends 7*c*1, first elastic arms 7*d*, and second elastic arms 7*e* of locking springs 7 are housed in the housing grooves 4*g*1. The proximal ends 7*c*1, first elastic arms 7*d*, and second elastic arms 7*e* can be displaced outward from the housing grooves 4*g*1 when they are elastically displaced. Therefore, spaces for displacement of the locking springs 7 need not be provided inside the housing 4, and therefore the connector 1 can be reduced in size in the front-back direction.

The side wall portions 4*f* are provided one at each end in the width direction X of the housing 4. The side wall portions 4*f* each have a slider fixing portion 4*d* and a reinforcing member fixing portion 4*d*4.

The slider fixing portion 4*d* is provided in each side wall portion 4*f* of the housing 4, and has a linear recessed portion 4*d*1.

The linear recessed portion 4*d*1 is a recessed portion along the height direction Z. A protruding portion 4*d*3 that protrudes outward is provided substantially in the middle in the height direction Z of the linear recessed portion 4*d*1. A slider portion 8*a* of the unlocking member 8 is partially housed in the linear recessed portion 4*d*1. An engaging portion 8*a*1 of the slider portion 8*a* engages with the protruding portion 4*d*3, and the slider portion 8*a* is thereby locked in the linear recessed portion 4*d*1.

The reinforcing member fixing portion 4*d*4 is provided on the lower side of each side wall portion 4*f* so as to protrude from the slider fixing portion 4*d* outward in the width direction X. The reinforcing members 6 are fixed to the outer side surfaces in the width direction X of the reinforcing member fixing portions 4*d*4. The reinforcing member fixing portions 4*d*4 are provided with slider insertion holes 4*d*2, into which the distal ends of the slider portions 8*a* of the unlocking member 8 are inserted. By inserting the slider portions 8*a* into such slider insertion holes 4*d*2, the slider portions 8*a* can be reliably fixed to the housing 4.

The insertion opening 4*a* is formed in the upper surface of the top wall 4*e* provided on the upper side of the housing 4. The insertion opening 4*a* communicates with the fitting chamber 4*b* inside the housing 4.

The fitting chamber 4*b* is provided inside the housing 4, and is formed so as to be surrounded by an inner wall 4*b*1 provided along the height direction Z. Locking spring fixing portions 4*b*2 are provided on the lower side of the fitting chamber 4*b*, and locking springs 7 described later are fixed to the locking spring fixing portions 4*b*2.

The terminal housing portions 4*c* are disposed in the inner wall 4*b*1 forming the fitting chamber 4*b*, in parallel along the width direction X of the housing 4. The terminal housing portions 4*c* communicate with the fitting chamber 4*b*, and the terminals 5 are housed one in each of the terminal housing portions 4*c*.

Terminals

Figure 10:
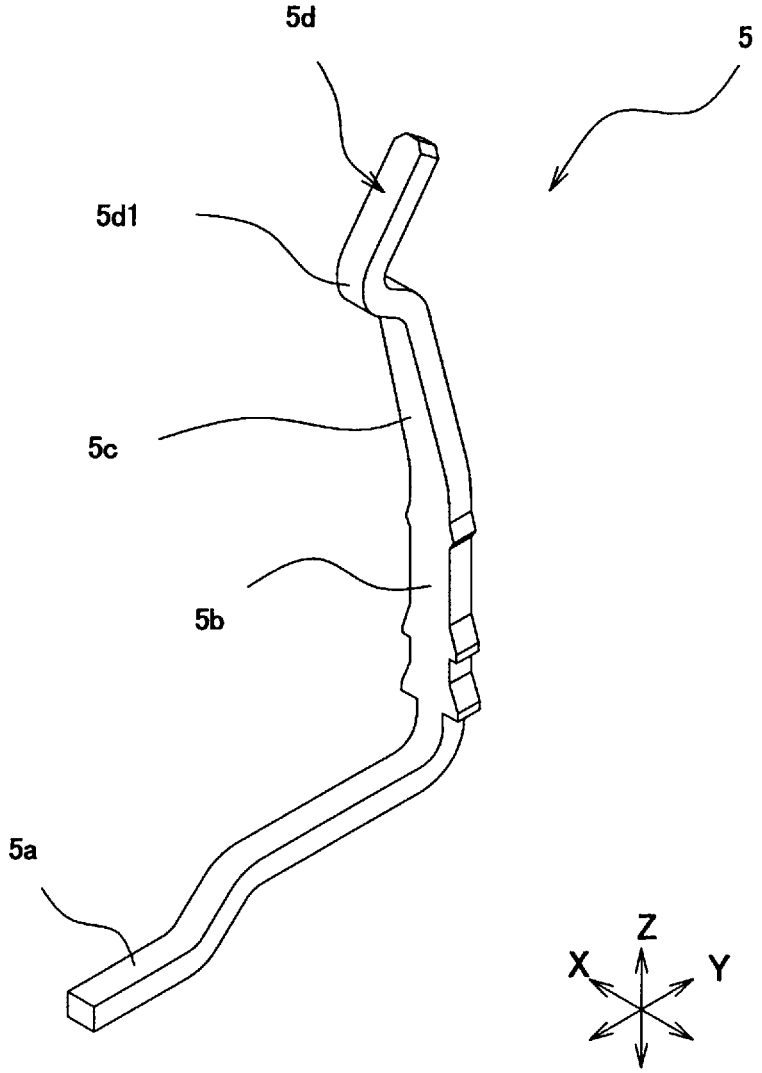
FIG. 10 is a perspective view showing the front, right side, and top of a terminal provided in the connector of FIG. 1.
Figure 11:
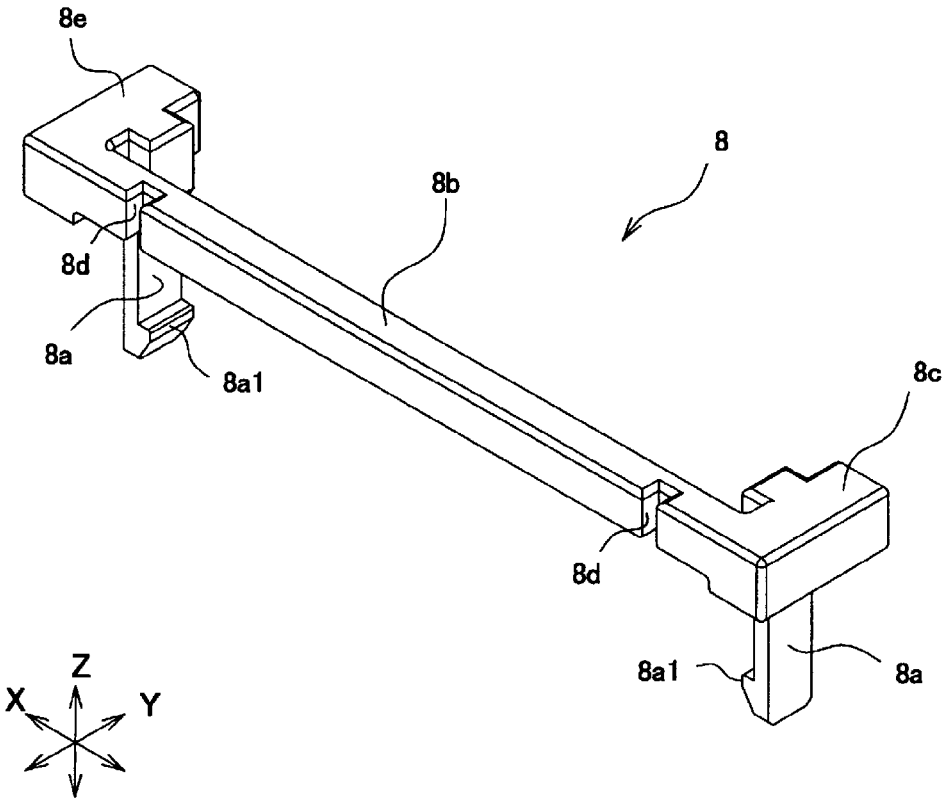
FIG. 11 is a perspective view showing the front, right side, and top of an unlocking member provided in the connector of FIG. 1.
Figure 12:
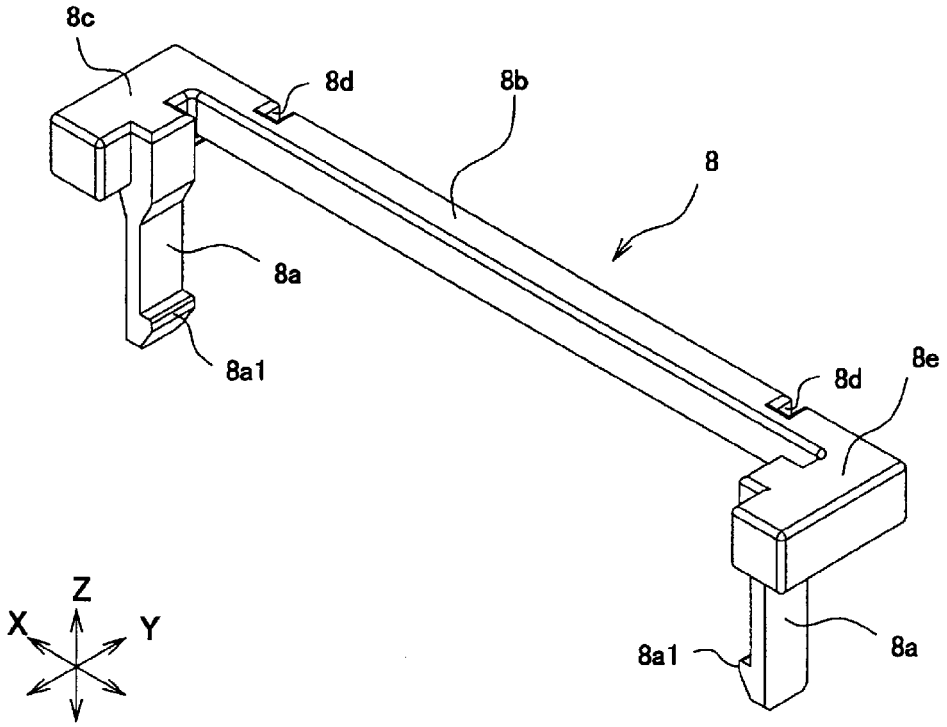
FIG. 12 is a perspective view showing the back, left side, and top of the unlocking member of FIG. 11.

The terminals 5 are formed by bending conductive metal plates, and are disposed in parallel along the width direction X of the housing 4 such that the terminals 5 are housed one in each of the terminal housing portions 4*c*. As shown in FIG. 10, the terminals 5 each have a circuit board connecting portion 5*a*, a fixing portion 5*b*, an elastic piece portion 5*c*, and a contact portion 5*d*.

The circuit board connecting portion 5*a* is provided at one end in the front-back direction Y of each terminal 5. All of the terminals 5 have the same shape, and when the terminals 5 are fixed to the terminal housing portions 4*c*, the circuit board connecting portions 5*a* of all of the terminals 5 protrude from the lower side of the front wall 4*g*. By soldering the circuit board connecting portions 5*a* to the circuit board 2, the terminals 5 are fixed to the circuit board 2.

The fixing portion 5*b* is continuous with the circuit board connecting portion 5*a*, passes through a back wall 4*b*3 provided on the lower side of the housing 4, and is fixed to the housing 4 here. The fixing portion 5*b* extends from the circuit board connecting portion 5*a* side along the front-back direction Y, bends, and extends along the height direction Z so as to form a substantially L-shape.

The elastic piece portion 5*c* extends upward from the upper end of the fixing portion 5*b*, in the manner of a cantilever along the height direction Z. The contact portion 5*d* is elastically supported at the distal end of the elastic piece portion 5*c*. The elastic piece portion 5*c* is elastically deformed inside the fitting chamber 4*b* so as to rotate about the junction with the fixing portion 5*b*, along the front-back direction Y of the connector 1.

The contact portion 5*d* bends in a V-shape in a direction in which it comes into contact with the flat conductor 3, and a contact point portion 5*d*1 that is electrically connected to the flat conductor 3 is formed. The contact point portion 5*d*1 protrudes from each terminal housing portion 4*c* into the fitting chamber 4*b* and comes into electrical contact with the flat conductor 3 inside the fitting chamber 4*b*.

Reinforcing Members

Figure 2:
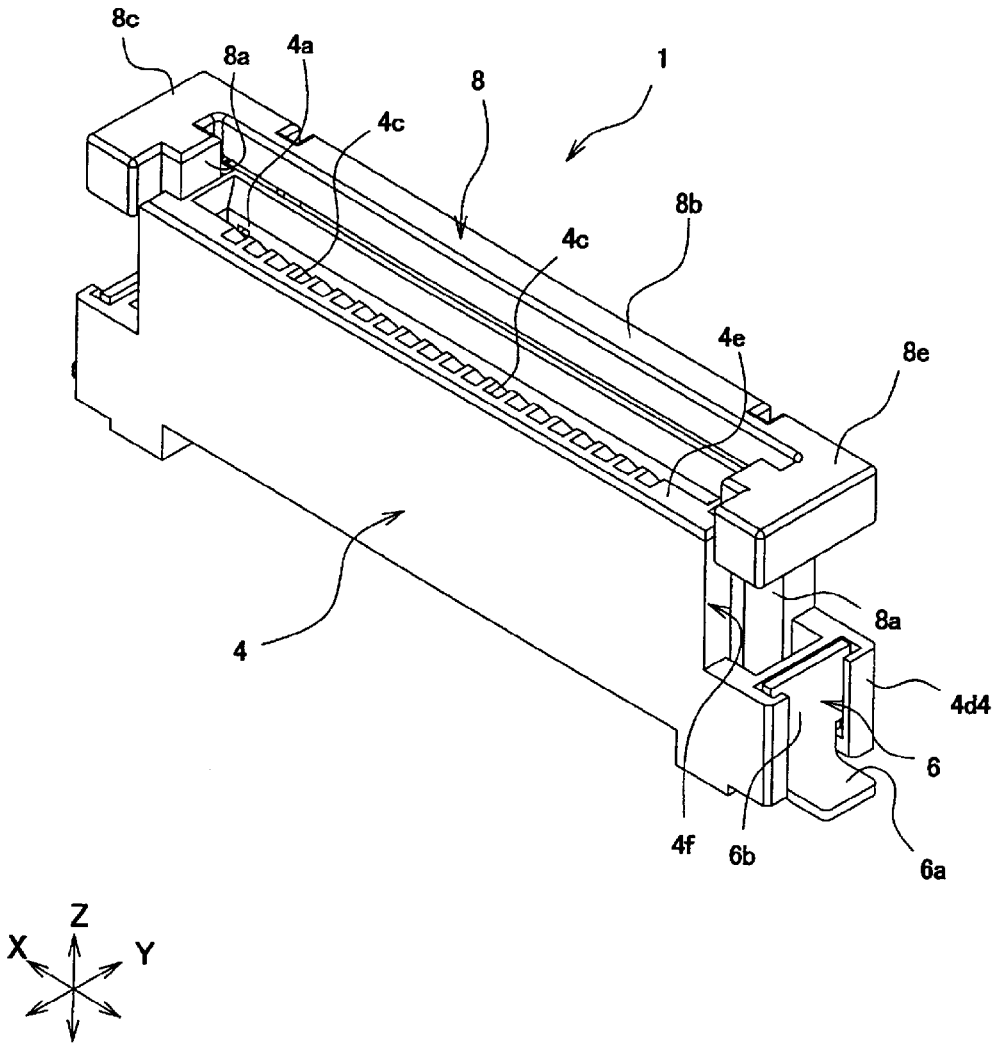
FIG. 2 is a perspective view showing the back, left side, and top of the connector of FIG. 1.
Figure 3:
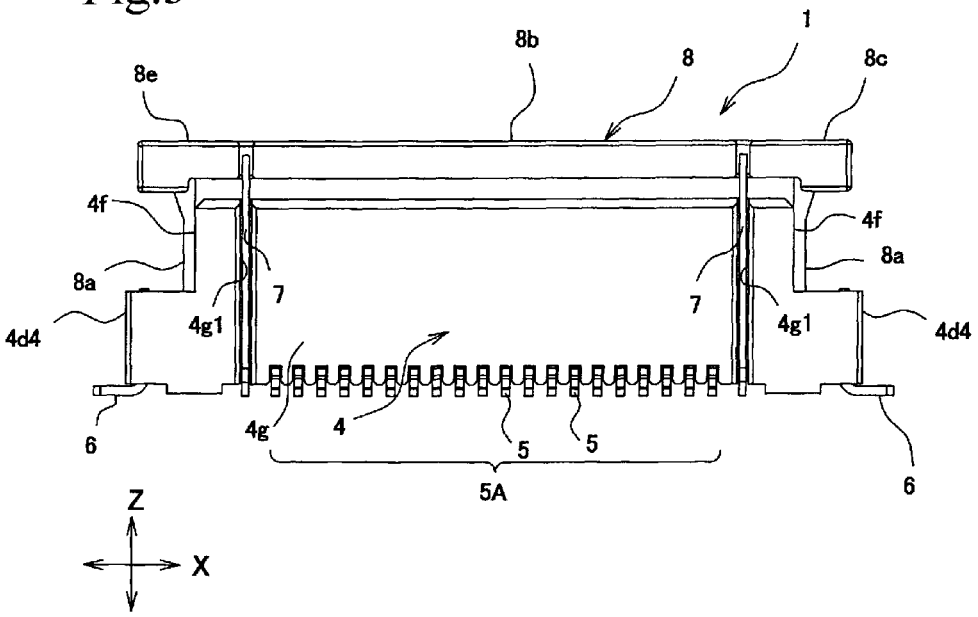
FIG. 3 is a front view of the connector of FIG. 1.
Figure 4:
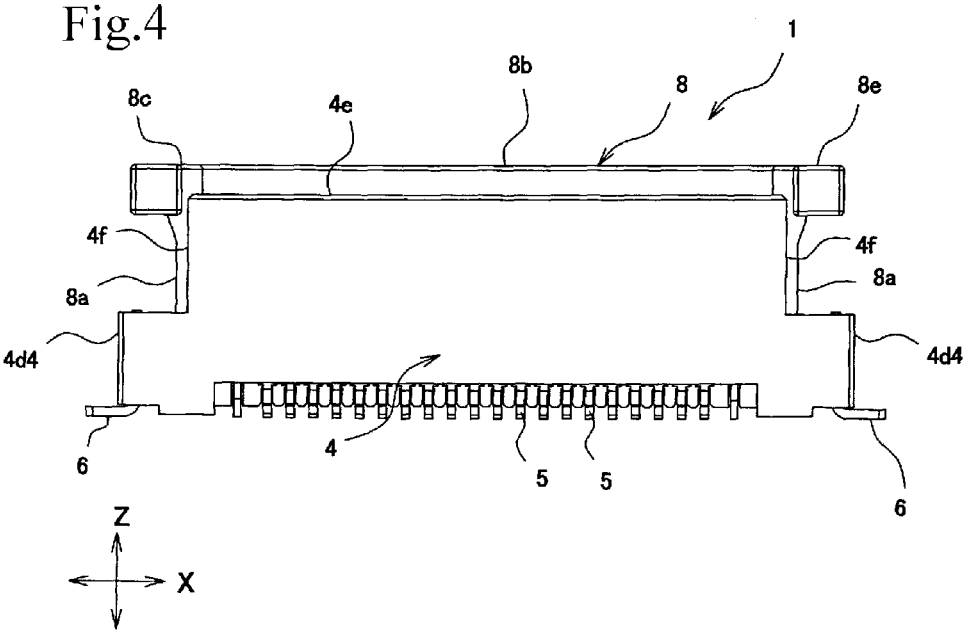
FIG. 4 is a back view of the connector of FIG. 1.
Figure 5:
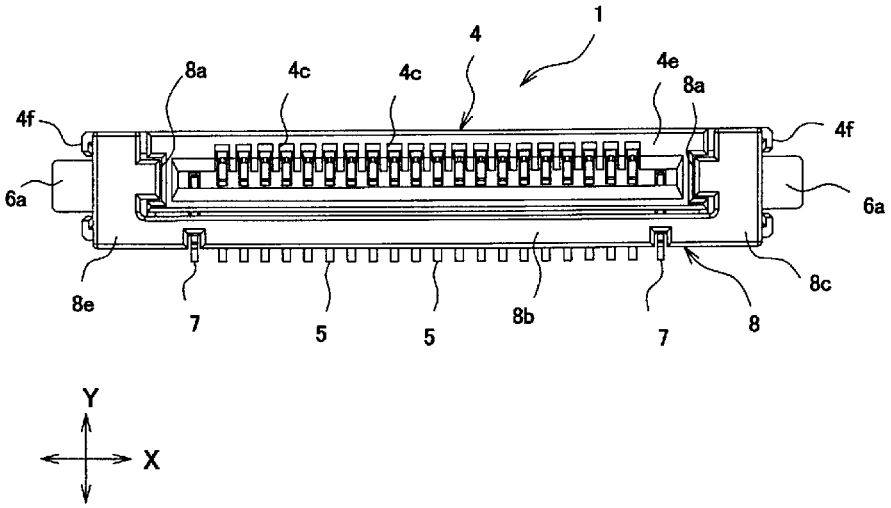
FIG. 5 is a top view of the connector of FIG. 1.
Figure 6:
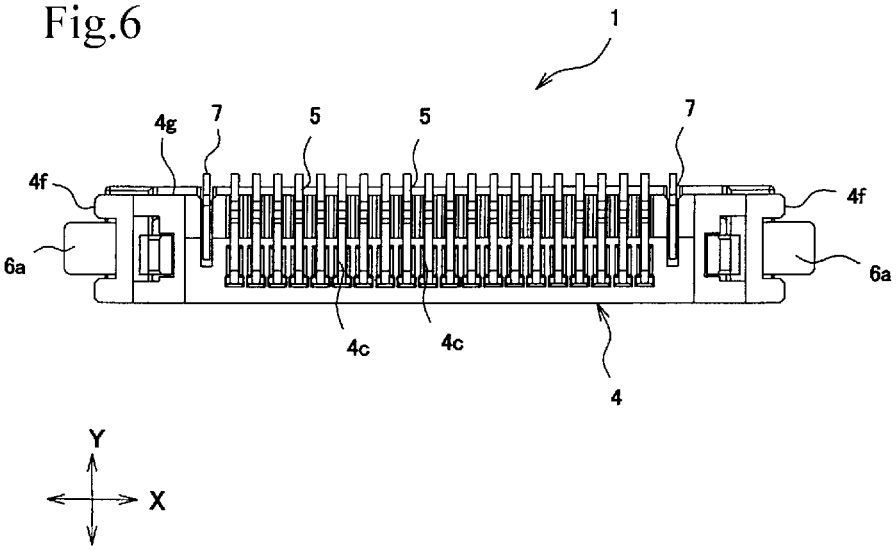
FIG. 6 is a bottom view of the connector of FIG. 1.
Figure 7:
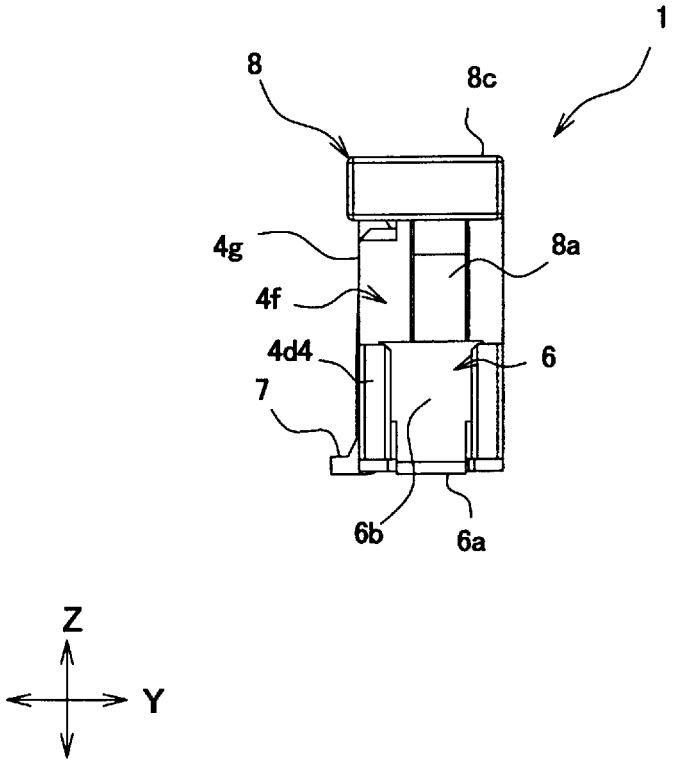
FIG. 7 is a right side view of the connector of FIG. 1.

The reinforcing members 6 are made by bending metal plates. As shown in FIGS. 1 and 2, the reinforcing members 6 each have a circuit board fixing portion 6*a* and a reinforcing plate 6*b*, and is substantially L-shape in cross-section. The reinforcing plates 6*b* of the reinforcing members 6 are attached to the reinforcing member fixing portions 4*d*4 of the side wall portions 4*f* of the housing 4, and reinforce the housing 4. The circuit board fixing portions 6*a* are soldered to the circuit board 2, and the housing 4 can thereby be fixed to the circuit board 2.

Locking Springs

Figure 13:
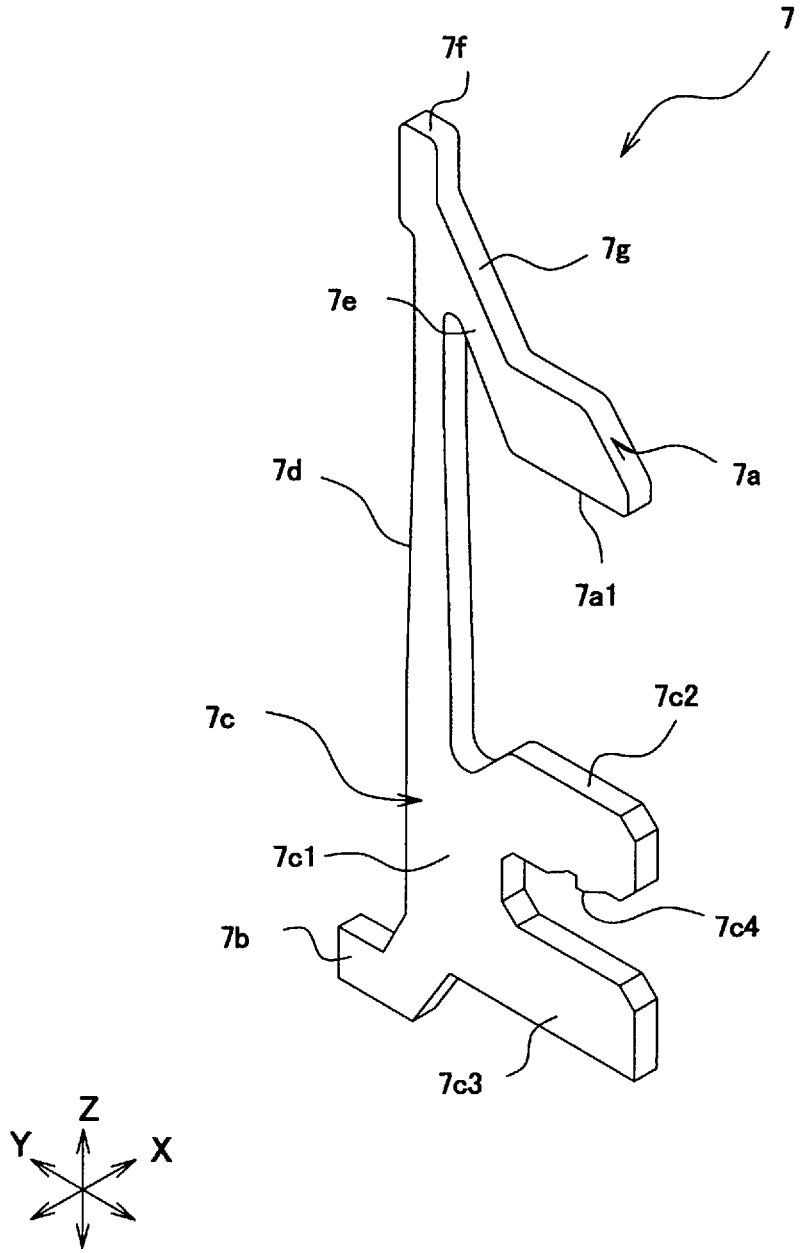
FIG. 13 is a perspective view showing the back, right side, and top of a locking member of the connector of FIG. 1.

The locking springs 7 are made into a flat plate shape by stamping a metal plate, and are plate-like pieces having a plate surface along the Y-Z plane. Therefore, compared to a case where the locking springs 7 have a plate surface along the width direction X, the connector 1 can be reduced in size in the width direction X. As shown in FIG. 13, the locking springs 7 each have a circuit board fixing portion 7*b*, a housing fixing portion 7*c* serving as a "fixing portion," a first elastic arm 7*d*, a second elastic arm 7*e* serving as a "protruding piece," an engaging piece 7*a*, and a positioning portion 7*f*.

The circuit board fixing portion 7*b* is disposed on the front side in the front-back direction Y of each locking spring 7. The circuit board fixing portion 7*b* has a plate edge parallel to the circuit board 2. By soldering the circuit board fixing portion 7*b* to the circuit board 2, each locking spring 7 is fixed to the circuit board 2.

The housing fixing portion 7*c* has a proximal end portion 7*c*1 that is continuous with the circuit board fixing portion 7*b*, and a first fixing piece portion 7*c*2 and a second fixing piece portion 7*c*3 that extend from the proximal end portion 7*c*1. The proximal end portion 7*c*1 is continuous with the back end of the circuit board fixing portion 7*b* and extends upward in the height direction Z.

The first fixing piece portion 7*c*2 extends from the proximal end portion 7*c*1 backward, to the opposite side from the side where the circuit board fixing portion 7*b* is provided, in the front-back direction Y. A protruding portion 7*c*4 is provided at the lower end of the first fixing piece portion 7*c*2.

The second fixing piece portion 7*c*3 also extends from the proximal end portion 7*c*1 toward the same side as the first fixing piece portion 7*c*2 in the front-back direction Y.

The first fixing piece portion 7*c*2 and the second fixing piece portion 7*c*3 are provided so as to be parallel to each other. The first fixing piece portion 7*c*2 and the second fixing piece portion 7*c*3 hold one of the locking spring fixing portions 4*b*2 of the housing 4 therebetween, and the protruding portion 7*c*4 of the first fixing piece portion 7*c*2 bites into the one of the locking spring fixing portions 4*b*2. The locking springs 7 are thereby reliably fixed to the housing 4.

The first elastic arm 7*d* is provided so as to be continuous with the housing fixing portion 7*c*. Particularly in this embodiment, the first elastic arm 7*d* extends from the upper end of the proximal end portion 7*c*1 upward along the height direction Z, and is elastically deformed toward and away from the flat conductor 3 in an inserted state. The first elastic arm 7*d* is tapered in width from the proximal end toward the distal end. Therefore, the first elastic arm 7*d* can be elastically deformed more flexibly at the distal end than at the proximal end.

The second elastic arm 7*e* is provided so as to be continuous with the upper side of the first elastic arm 7*d*. The plate width of the second elastic arm 7*e* is substantially the same as that of the distal end of the first elastic arm 7*d*. Particularly in this embodiment, the second elastic arm 7*e* extends obliquely downward in the height direction Z and toward the inside of the fitting chamber 4*b*. The second elastic arm 7*e* is elastically deformed toward and away from the first elastic arm 7*d*. A sliding contact portion 7*g* is formed on the oblique edge on the upper side of the second elastic arm 7*e*.

The engaging piece 7*a* is provided so as to be continuous with the lower end of the second elastic arm 7*e*, and is elastically supported by the second elastic arm 7*e*. The engaging piece 7*a* has, on its lower end face, an engaging end portion 7*a*1 along the plate thickness direction of the flat conductor 3. The engaging piece 7*a* enters the inside of a locking portion 3*c* of the flat conductor 3, and the engaging end portion 7*a*1 engages with an engaging edge 3*e* of the locking portion 3*c*. The flat conductor 3 is thereby locked in the housing 4.

The positioning portion 7*f* is provided so as to be continuous with the first elastic arm 7*d*. The positioning portion 7*f* is a protruding portion that extends upward from the upper end of the first elastic arm 7*d*.

The locking springs 7 are provided one at each end of a row 5A of the terminals 5. Therefore, even when the number of terminals 5 provided in the connector 1 or the length of the housing 4 in the width direction X is changed, the same locking springs 7 can be used. Therefore, connectors 1 having different number of terminals 5 can be easily manufactured.

Unlocking Member

The unlocking member 8 has a connecting portion 8*b*, a first pressing operation surface 8*c*, a second pressing operation surface 8*e*, and slider portions 8*a*. The unlocking member 8 is provided such that its upper surface protrudes above the top wall 4*e* of the housing 4.

The connecting portion 8*b* is provided along the width direction X in a bar shape. The connecting portion 8*b* is disposed on the front side in the front-back direction Y, and on the upper side of the front wall 4*g*. The connecting portion 8*b* has a groove-like insertion portion 8*d* at each end in the width direction X. The positioning portions 7*f* of the locking springs 7 are disposed one inside each of the insertion portions 8*d*, so that the locking springs 7 are not displaced relative to the unlocking member 8. Pressing portions 8*d*1 provided inside and at the lower ends of the insertion portions 8*d*, can slide on the sliding contact portions 7*g* of the locking springs 7 while pressing the sliding contact portions 7*g*.

The first pressing operation surface 8*c* and the second pressing operation surface 8*e* are disposed at both ends in the width direction X of the connecting portion 8*b*. Particularly in this embodiment, the first pressing operation surface 8*c* and the second pressing operation surface 8*e* are disposed on both sides of the insertion opening 4*a*. By such arrangement, the pressing operation surfaces 8*c* and 8*e* can be provided such that they do not protrude in the front-back direction Y, and therefore, the connector 1 can be reduced in size in the front-back direction Y. Owing to such arrangement, fingers that perform pressing operation can easily touch the pressing operation surfaces 8*c* and 8*e* such that they interfere with the upper surface of the housing 4 as little as possible, and the pressing operation can be reliably performed. In addition, as described above, the upper surface of the unlocking member 8 protrudes above the top wall 4*e* of the housing 4, and the pressing operation surfaces 8*c* and 8*e* also protrude above the top wall 4*e*. Therefore, the pressing operation surfaces 8*c* and 8*e* are easy for a worker to press. Such pressing operation surfaces 8*c* and 8*e* are flat surfaces. Therefore, the pressing operation surfaces 8*c* and 8*e* can be used as sucked surfaces during automatic mounting.

The slider portions 8*a* are elongated piece portions that extend downward along the height direction Z from both ends in the width direction X of the connecting portion 8*b*, and from the lower sides of the pressing operation surfaces 8*c* and 8*e*. Engaging portions 8*a*1 to be engaged with the housing 4 are provided at the distal ends of the slider portions 8*a*, and are engaged with the protruding portions 4*d*3 provided in the linear recessed portions 4*d*1 of the housing 4.

The unlocking member 8 is supported by the locking springs 7, with the sliding contact portions 7*g* of the locking springs 7 in contact with the pressing portions 8*d*1 from below (see FIG. 15).

In this embodiment, the unlocking member 8 is provided separately from the housing 4. Therefore, molds for molding can be simpler, and therefore manufacturing is easy. For example, by painting the unlocking member 8 and the housing 4 in different colors, the unlocking member 8 and the housing 4 can be made easily visually distinguishable for a worker. If the unlocking member 8 that is movable relative to the housing 4 is integral with the housing 4, the connecting part therebetween is fragile and easily broken. By forming them as separate members, they can be made less breakable.

Flat Conductor

Figure 14:
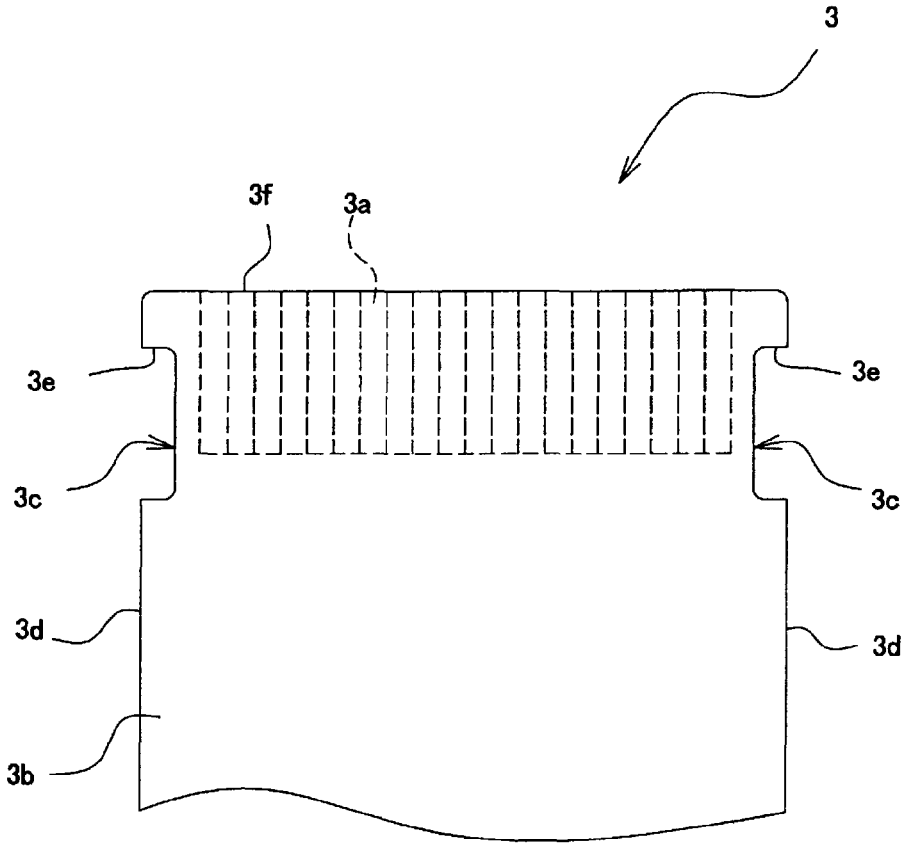
FIG. 14 is a plan view of a flat conductor to be electrically connected to the connector of FIG. 1.

The configuration of the flat conductor 3 that is an object to be connected to the connector 1 in this embodiment, will be described. As shown in FIG. 14, the flat conductor 3 has a conductive portion 3*a*, an insulating layer 3*b*, and locking portions 3*c*.

The conductive portion 3*a* is made of a conductive metal sheet, and both surfaces of the conductive portion 3*a* are covered by the insulating layer 3*b*. On the side of a distal end portion 3*f* that serves as an insertion end into the housing 4, the conductive portion 3*a* is exposed from the insulating layer 3*b* to the outside, and comes into electrical contact with the terminals 5 of the connector 1 in this exposed part. In this embodiment, the terminals 5 comes into contact with the conductive portion 3*a* from one side, and therefore only one side of the conductive portion 3*a* is exposed from the insulating layer 3*b*.

The insulating layer 3*b* is an insulating coating, and is layered on both surfaces of the conductive portion 3*a* as described above.

As shown in FIG. 14, the locking portions 3*c* are recessed portions that are provided one in each of side edge portions 3*d* along the insertion direction of the flat conductor 3. The locking portions 3*c* are formed as cutouts such that the side edge portions 3*d* of the flat conductor 3 are cut out in a U-shape. The locking portions 3*c* each have an engaging edge 3*e* that is a plate edge along the width direction X of the flat conductor 3. The engaging pieces 7*a* of the locking springs 7 described later engage with the engaging edges 3*e*. Although the locking portions 3*c* are U-shaped in this embodiment, the locking portions 3*c* may be, for example, through-holes as long as they have such a shape that the engaging pieces 7*a* can engage with them.

Description of how to Fit Flat Conductor

Next, how to use the connector 1 will be described.

Figure 15:
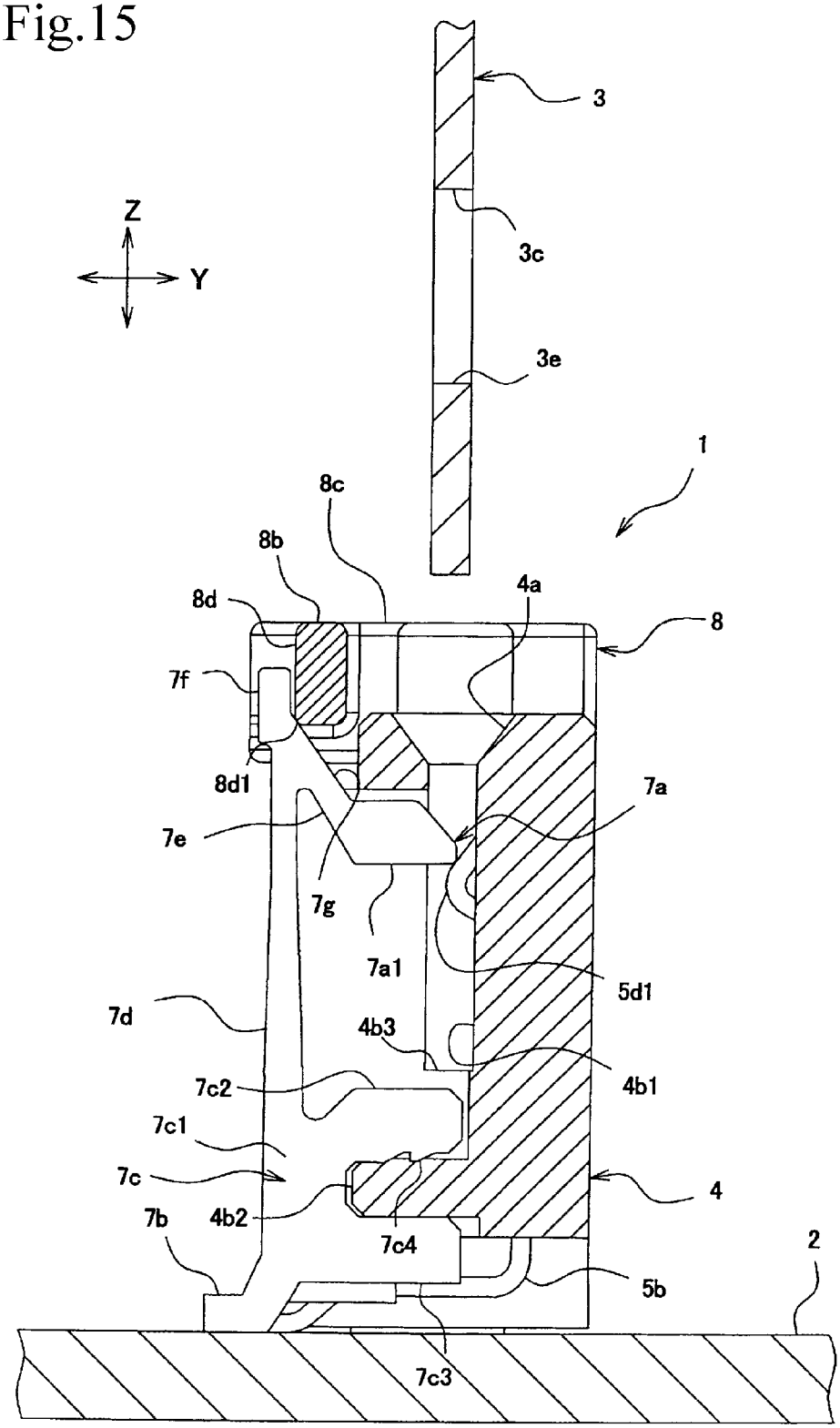
FIG. 15 is a sectional view showing a state before the fitting of the flat conductor into the connector of FIG. 1.
Figure 16:
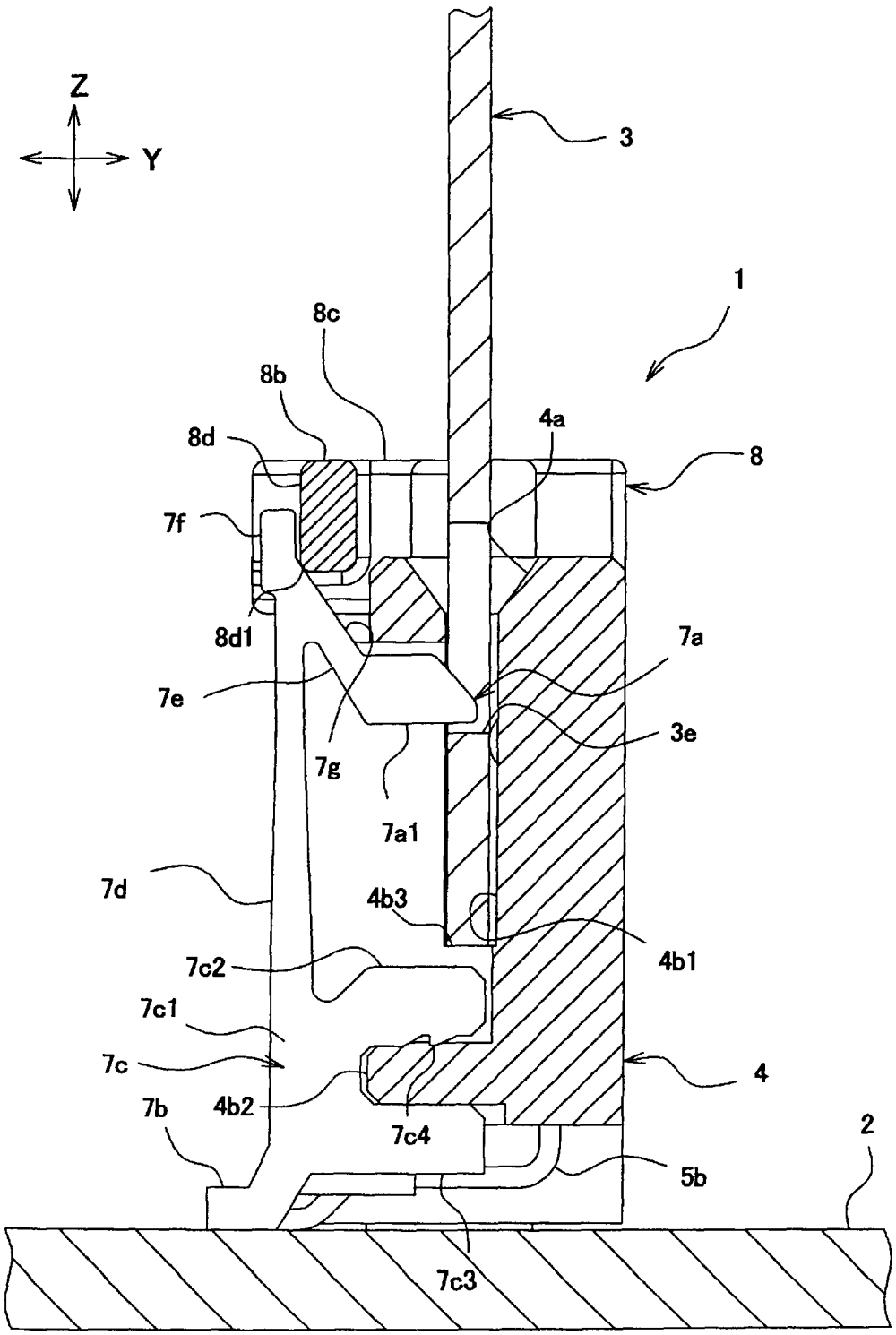
FIG. 16 is a sectional view showing a state where the flat conductor of FIG. 15 is inserted into a fitting chamber of the connector and is locked by locking members.
Figure 17:
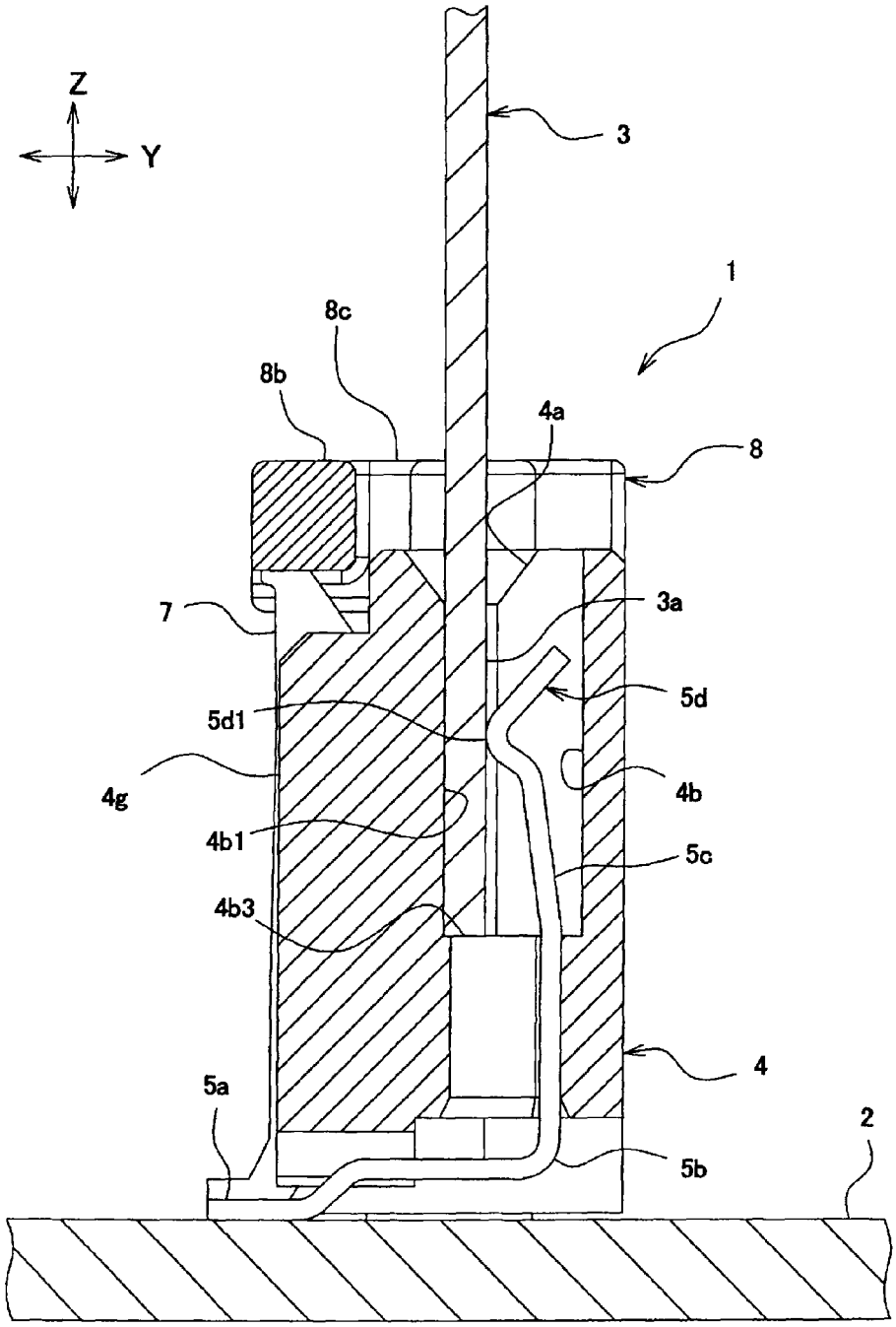
FIG. 17 is a sectional view showing a state where, in the state of FIG. 16, terminals are in electrical contact with the flat conductor.

First, as shown in FIGS. 15 and 16, the flat conductor 3 is inserted through the insertion opening 4*a* into the fitting chamber 4*b*. The distal end portion 3*f* of the flat conductor 3 first touches and presses the locking pieces 7*a* of the locking springs 7, and the first elastic arms 7*d* are elastically deformed so as to rotate away from the flat conductor 3 in the front-back direction Y. Then, the second elastic arms 7*e* are also elastically deformed away from the flat conductor 3 and toward the first elastic arms 7*d*. Thus, the engaging pieces 7*a* are displaced away from the flat conductor 3 in the front-back direction Y, and the distal end of the flat conductor 3 gets over the engaging pieces 7*a*. Then, restoring force acts on the first elastic arms 7*d* and the second elastic arms 7*e* such that the engaging pieces 7*a* return toward the flat conductor 3 in the front-back direction Y. Therefore, the flat conductor 3 is pressed against the inner wall 4*b*1 by the engaging pieces 7*a*, and, in this state, the flat conductor 3 is inserted into the fitting chamber 4*b* of the connector 1 along the inner wall 4*b*1 of the fitting chamber 4*b*. Since the first elastic arms 7*d* are housed in the housing grooves 4*g*1 provided in the housing 4, the deformation in the width direction X is limited.

After that, the flat conductor 3 is further inserted toward the bottom of the fitting chamber 4*b*, with the engaging pieces 7*a* of the locking springs 7 elastically deformed. The distal end portion 3*f* of the flat conductor 3 touches the contact portions 5*d* of the terminals 5 from above, and elastically deforms the contact portions 5*d* away from the terminals 5 in the front-back direction Y. Thus, the distal end portion 3*f* of the flat conductor 3 gets over the contact point portions 5*d*1. The conductive portion 3*a* of the flat conductor 3 comes into electrical contact with the contact point portions 5*d*1 of the terminals 5, with the contact portions 5*d* pressing the flat conductor 3 against the inner wall 4*b*1.

Locking Structure of Flat Conductor

As described above, when the flat conductor 3 is inserted to the bottom of the fitting chamber 4*b*, the locking portions 3*c* of the flat conductor 3 reach the engaging pieces 7*a* of the locking springs 7. The engaging pieces 7*a* are displaced by the restoring force of the first elastic arms 7*d* and the second elastic arms 7*e* toward the flat conductor 3 in the front-back direction Y, and enter the insides of the locking portions 3*c*. Then, the end faces of the locking end portions 7*a*1 provided in the engaging pieces 7*a* are along the plate thickness direction of the flat conductor 3, that is, a direction perpendicular to the insertion direction of the flat conductor 3. When, in this state, the flat conductor 3 is pulled in the extraction direction, the engaging end portions 7*a*1 touch and engage with the engaging edges 3*e* of the locking portions 3*c*, and thereby locks the connector 1 (FIG. 16). Thus, the connector 1 and the flat conductor 3 can be kept connected. As described above, in the connector 1 of this embodiment, the above-described locking can be performed only by one action of inserting the flat conductor 3 into the connector 1, and therefore the fitting work is easy.

In this embodiment, the flat conductor 3 is inserted into the fitting chamber 4*b* not along a movable member having the possibility of causing backlash, such as an actuator or a slider, but along the surface of the inner wall 4*b*1 of the fitting chamber 4*b* of the housing 4 itself. Therefore, a reliable fitting state without any unstable factors such as backlash can be kept.

How to Extract Flat Conductor

A vertical-type connector into which a flat conductor 3 is inserted perpendicularly to a circuit board 2, can be tall, that is, the length in the height direction Z is long relative to the length in the front-back direction Y. Such a vertical-type connector is largely protruded from the circuit board 2, and is therefore prone to be inclined to the circuit board 2. Therefore, if the connector is subjected to a large force in the front-back direction Y, the connector may fall to the opposite side. When, on the circuit board 2, other mounted components are close to the connector, it is easier to press the pressing operation surfaces 8*c* and 8*e* of the unlocking member 8 in the front-back direction Y than to press them in the height direction Z because a large space is not needed in the plate surface direction of the circuit board 2. In addition, because the pressing operation toward the circuit board 2 can be sensuously performed for a worker, the operation can be easily performed. So, in this embodiment, by pressing the unlocking member 8 along the height direction Z toward the circuit board 2, the engaging pieces 7*a* can be disengaged from the locking portions 3*c* of the flat conductor 3. How to extract the flat conductor 3 will be described specifically below.

Figure 18:
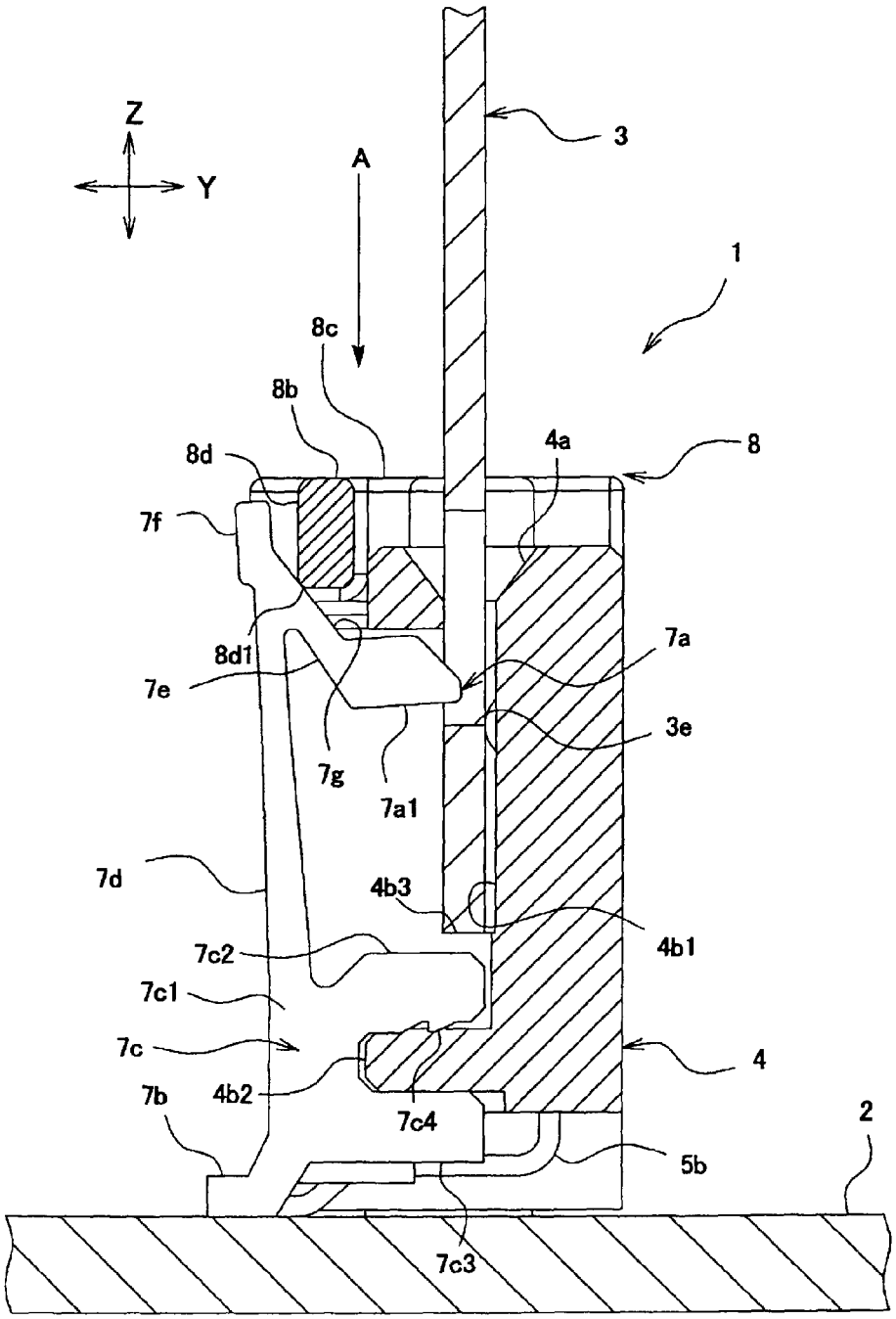
FIG. 18 is a sectional view showing a state where, from the state of FIG. 16, pressing operating members of the unlocking member are pressed.
Figure 19:
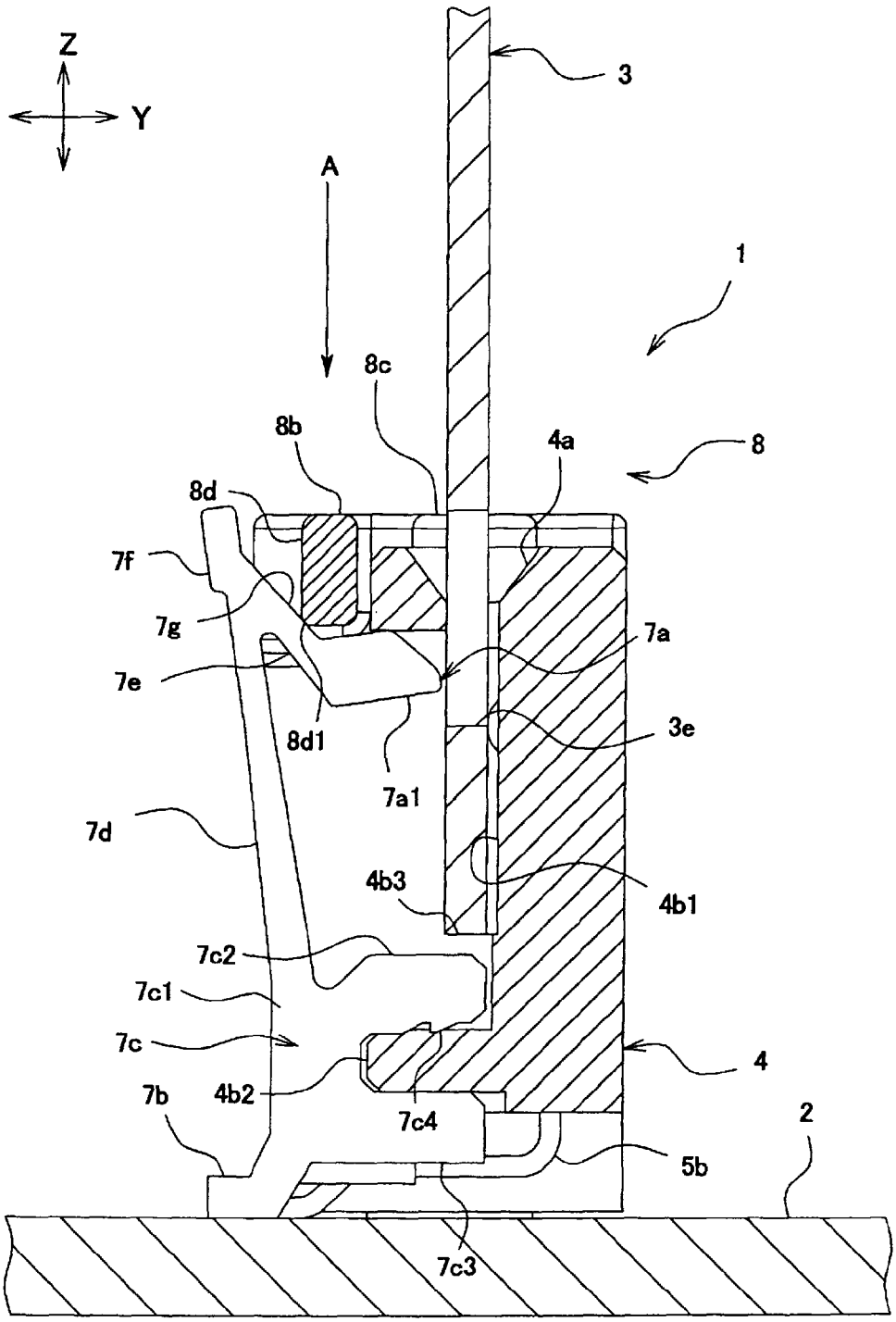
FIG. 19 is a sectional view showing a state where, from the state of FIG. 18, the pressing operating members of the unlocking member are further pressed, and the lock by the locking members is released.

When extracting the flat conductor 3, the pressing operation surfaces 8*c* and 8*e* of the unlocking member 8 are pressed down from above as shown by arrow A (FIGS. 18 and 19). The pressing portions 8*d*1 of the unlocking member 8 thereby press the sliding contact portions 7*g* provided in the second elastic arms 7*e* of the locking springs 7.

Since the sliding contact portions 7*g* are inclined to the height direction Z, pressing operating force can be smoothly converted into rotational displacing force that rotates the first elastic arms 7*d* and the second elastic arms 7*e*, by bringing the pressing portions 8*d*1 into oblique sliding contact with the sliding contact portions 7*g*. Therefore, the sliding contact portions 7*g* subjected to pressing operating force that is downward in the height direction Z by the pressing portions 8*d*1 of the unlocking member 8 are rotationally displaced downward and away from the flat conductor 3 (to the front side in this embodiment) in the front-back direction Y. The first elastic arms 7*d* rotate about the housing fixing portions 7*c*, particularly about the proximal end portions 7*c*1 so as to fall down. The second elastic arms 7*e* that are continuous with the distal ends of the first elastic arms 7*d* also rotate in conjunction with the first elastic arms 7*d* in the same direction. The pressing portions 8*d*1 of the unlocking member 8 slide on the sliding contact portions 7*g*. Thus, the engaging pieces 7*a* go out of the locking portions 3*c* of the flat conductor 3, and the locking springs 7 are disengaged from the flat conductor 3. Meanwhile, the flat conductor 3 is extracted from the fitting chamber 4*b* of the housing 4. Then, the distal ends of the positioning portions 7*f* of the locking springs 7 protrude above the insertion portions 8*d* of the unlocking member 8. Therefore, a worker can visually confirm that the unlocking member 8 is sufficiently pressed.

After that, the pressing of the pressing operation surfaces 8*c* and 8*e* of the unlocking member 8 is stopped, and the first elastic arms 7*d* of the locking springs 7 try to return to the state before pressing, that is, the state along the height direction Z. The second elastic arms 7*e* also try to return to the state inclined to the height direction Z. Then, the unlocking member 8 is displaced upward in the height direction Z such that the whole unlocking member 8 is lifted by the sliding contact portions 7*g* of the locking springs 7.

As described above, according to this embodiment, by pressing the pressing operation surfaces 8*c* and 8*e* of the unlocking member 8 downward in the height direction Z, the first elastic arms 7*d* and the second elastic arms 7*e* are rotated about the housing fixing portions 7*c*, particularly about the proximal end portions 7*c*1, and the engaging pieces 7*a* can be disengaged from the flat conductor 3.

The unlocking member 8 has slider portions 8*a*, which are housed in the linear recessed portions 4*d*1 provided in the housing 4. Therefore, the slider portions 8*a* are displaced inside the linear recessed portions 4*d*1 along the height direction Z, and the unlocking member 8 can thereby also be smoothly displaced. Owing to such slider portions 8*a* and linear recessed portions 4*d*1, the unlocking member 8 can be operated more easily.

As described above, in the connector 1, one unlocking member 8 can press a plurality of locking springs 7. Therefore, compared to a case where different unlocking members 8 press a plurality of locking springs 7, the number of components can be reduced.

As described above, according to the connector 1 of this embodiment, even when other components are densely mounted on the circuit board 2, the flat conductor 3 can be easily disengaged. Therefore, the connector 1 can be mounted on the circuit board 2 closely to other mounted components, and therefore a small space on the circuit board 2 can be effectively utilized.

Modifications

In the above-described embodiment, pressing operation surfaces 8*c* and 8*e* are provided at both ends in the width direction X of the unlocking member 8. Alternatively, for example, only one pressing operation surface may be provided in the middle of the connecting portion 8*b* in the width direction X. By doing so, two locking springs 7 can be operated by pressing one pressing operation surface.

In the above-described embodiment, the insertion portions 8*d* are grooves. Alternatively, the insertion portions 8*d* may be through-holes provided in the unlocking member 8. Also in this case, the upper ends of the positioning portions 7*f* housed in the insertion portions protrude above the unlocking member 8, with the unlocking member 8 depressed by pressing the operation surfaces 8*c* and 8*e*, and a worker can thereby visually confirm that the unlocking member 8 is sufficiently depressed.

What is claimed is:

1. A connector comprising:

a housing that has a fitting chamber with an insertion opening for a flat conductor in the upper surface thereof and whose lower side is placed on a circuit board;

at least one locking spring that locks the flat conductor in the fitting chamber; and an unlocking member that is displaced by a pressing operation toward the circuit board, wherein the at least one locking spring has a fixing portion that is fixed to the housing, an elastic arm that is rotationally displaced about the fixing portion away from the flat conductor, an engaging piece that engages with a locking portion of a through-shape provided in the flat conductor, and a sliding contact portion that comes into oblique sliding contact with the unlocking member displaced by the pressing operation, rotates the elastic arm about the fixing portion away from the flat conductor, and extracts the engaging piece from the locking portion, wherein the housing has at least one groove portion that is open to the outside of the housing and houses the at least one locking spring displaceably to the outside of the housing.

2. The connector according to claim 1, wherein the at least one locking spring has a flat plate shape.

3. The connector according to claim 1, wherein the at least one locking spring comprises a plurality of locking springs, and the plurality of locking springs are disposed at both ends in the width direction of the insertion opening.

4. The connector according to claim 1, wherein the sliding contact portion is an oblique edge formed in a protruding piece protruding obliquely from the distal end of the elastic arm.

5. The connector according to claim 4, wherein the engaging piece protrudes from the lower end of the oblique edge toward the fitting chamber.

6. The connector according to claim 1, wherein the unlocking member has at least one pressing operating surface on the upper surface side of the housing in which the insertion opening is open.

7. The connector according to claim 6, wherein the at least one pressing operating surface is located above the upper surface of the housing.

8. The connector according to claim 6, wherein the at least one pressing operating surface comprises a plurality of pressing operating surfaces, and the plurality of pressing operating surfaces are located at both ends in the longitudinal direction of the upper surface of the housing.

9. The connector according to claim 6, wherein the at least one pressing operating surface comprises a plurality of pressing operating surfaces, and the plurality of pressing operating surfaces are located so as to protrude to the side of both ends in the longitudinal direction of the upper surface of the housing.

10. The connector according to claim 6, wherein the at least one pressing operating surface is a flat surface.

11. The connector according to claim 1, wherein the unlocking member has a first pressing operation surface located at one longitudinal end of the upper surface of the housing, a second pressing operation surface located at the other longitudinal end of the upper surface of the housing, and a connecting portion bridged between the first and second pressing operation surfaces along the longitudinal direction of the upper surface of the housing.

12. The connector according to claim 1, wherein the at least one locking spring comprises a pair of locking springs, and the pair of locking springs are disposed at both ends of a row of terminals electrically connected to the flat conductor.

13. A connector comprising:

a housing that has a fitting chamber with an insertion opening for a flat conductor in the upper surface thereof and whose lower side is placed on a circuit board;

at least one locking spring that locks the flat conductor in the fitting chamber; and an unlocking member that is displaced by a pressing operation toward the circuit board, wherein the at least one locking spring has a fixing portion that is fixed to the housing, an elastic arm that is rotationally displaced about the fixing portion away from the flat conductor, an engaging piece that engages with a locking portion of a through-shape provided in the flat conductor, and a sliding contact portion that comes into oblique sliding contact with the unlocking member displaced by the pressing operation, rotates the elastic arm about the fixing portion away from the flat conductor, and extracts the engaging piece from the locking portion, wherein the unlocking member has an insertion portion through which the upper end of the elastic arm is passed, and, when the unlocking member is displaced by the pressing operation to a position where the engaging piece is extracted from the locking portion, the upper end of the elastic arm protrudes from the insertion portion.

* * * * *